US005700755A

United States Patent [19]

Morrison et al.

[11] Patent Number: 5,700,755

[45] Date of Patent: Dec. 23, 1997

[54] THERMAL TRANSFER PRINTING RECEIVER SHEET

[75] Inventors: Gary Wayne Morrison, London; Stephen Mann; Christopher Bennett, both of Essex, all of United Kingdom

[73] Assignee: Imperial Chemical Industries PLC, United Kingdom

[21] Appl. No.: 513,838

[22] PCT Filed: Mar. 23, 1994

[86] PCT No.: PCT/GB94/00608

§ 371 Date: Sep. 5, 1995

§ 102(e) Date: Sep. 5, 1995

[87] PCT Pub. No.: WO94/21470

PCT Pub. Date: Sep. 29, 1994

[30] Foreign Application Priority Data

Mar. 24, 1993 [GB] United Kingdom ..... 9306073.9

[51] Int. Cl.[6] ..... B41M 5/035; B41M 5/38

[52] U.S. Cl. ..... 503/227; 428/195; 428/304.4; 428/913; 428/914

[58] Field of Search ..... 8/471; 428/195, 428/304.4, 913, 914; 503/227

[56] References Cited

FOREIGN PATENT DOCUMENTS

| | | | |
|---|---|---|---|
| 0 234 563 | 9/1987 | European Pat. Off. | 503/227 |
| 0 283 048 | 9/1988 | European Pat. Off. | 503/227 |
| 0 439 049 | 7/1991 | European Pat. Off. | 503/227 |

*Primary Examiner*—Bruce H. Hess

[57] ABSTRACT

A thermal transfer printing receiver sheet comprises a substrate having on one side a dye receiving layer, wherein the substrate comprises a porous material, preferably a porous plastics material having a network of interconnecting pores communicating throughout the substrate and wherein dye from an image printed in the dye receiving layer is prevented from permeating into the substrate by a sub-layer interposed between the substrate and the receiving layer.

19 Claims, No Drawings

THERMAL TRANSFER PRINTING RECEIVER SHEET

This invention relates to a thermal transfer printing receiver sheet, and in particular to a receiver sheet having a porous substrate.

Thermal transfer printing is a printing process in which a dye is caused by thermal stimuli to transfer from a dye sheet to a receiver sheet by diffusion and/or sublimation. In such processes the dye sheet and receiver sheet are placed in intimate contact, the thermal stimuli are applied to predetermined areas of the dye sheet and the dye is selectively transferred to the receiver to form the desired image. The dye sheet and receiver sheet are then separated.

Receiver sheets conventionally comprise a substrate with a dye receiving surface on one side into which a dye is thermally transferable and retainable. The dye-receiving surface may be provided by one side of the substrate, however, receiver sheets typically comprise a substrate supporting a receiving layer which layer presents a dye-receiving surface. The receiving layer typically comprises a dye-receptive polymer, a cross-linking agent and a release system.

Substrates conventionally employed in thermal transfer printing include thermoplastic films, for example polyethylene terephthalate, and laminated paper substrates.

Receiver sheets, for example in the form of a card, have found wide usage in security applications, for example credit cards, charge cards, identification cards, driving licences and passports.

Where the receiver sheet comprises a solid plastics substrate problems with security may be encountered where, on attempting to replace a layer on the sheet by delaminating the layers within the recording sheet, fracture tends to occur at the boundary between adjoining layers rather than through the substrate itself. Consequently there may not be significant evidence that the receiver sheet has been tampered with and thus a significant security risk my be presented. Laminated paper substrates also have a drawback in that they have relatively poor durability when exposed to solvents or water as may occur in for example flush cut card applications, that is where the edge of a card is removed during the production process and presents an exposed cross-section of the layers in the card.

U.S. Pat. No. 4,861,644 discloses the use of a microporous material as a printing substrate for printing inks. There is however no disclosure of such substrates being suitable for use with thermally transferable dyes in thermal transfer printing.

We have now found that drawbacks associated with prior art receiver sheets may be reduced by providing substrate comprising a porous plastics material.

According to a first aspect of the invention, there is provided a thermal transfer printing receiver sheet comprising a substrate having on one side thereof a dye receiving layer wherein the substrate comprises a porous plastics material having a network of interconnecting pores communicating throughout the substrate.

Such a substrate provides excellent durability and resistance to solvents or water as compared with laminated paper substrates. A significant practical benefit of these advantages is that the wear, ageing and handling characteristics of the receiver sheet are significantly improved.

Furthermore, the porous structure of the substrate employed in the present invention reduces the possibility of fracture occurring between adjacent layers of the receiver sheet in the event that delamination is attempted as the substrate itself may fracture internally before delamination occurs. Thus a greater degree of security is provided due to the reduced possibility of delamination of the layers of the receiver sheet, and also due to the evidence of tampering with the receiver sheet provided by the fracture substrate of the receiver sheet.

The substrate is preferably a single layer rather than a multi-layer laminate although a laminate may be employed as the substrate if desired. The preferred single layer substrate may comprise one porous plastics material or, if desired, a plurality of porous plastics materials which are suitably mixed or blended, preferably to provide a substantially homogenous polymer blend such that a single layer substrate is provided.

Suitable porous plastics materials for use in the present invention include polyolefins, for example polyethylene, polypropylene and polybutene.

The substrate may also comprise other components such as other thermoplastic polymers, for example acrylic acid/polyethylene copolymers, and fillers, for example silica.

Preferably, the pores have a maximum dimension of 0.01 to 20 microns, more preferably 0.1 to 10 microns, especially 0.3 to 5 microns. Suitably the pores are generally spherical cavities but, if desired, may be fissures in which the length of the pore is significantly greater than the width thereof. The pore shape and size may be tailored as desired by stretching the substrate either uniaxially or biaxially.

Suitably, the porous plastics material has a void volume of at least 50%, that is, for any given volume of the plastic material, the pores represent at least 50% of that volume. Without a significant void volume, the substrate is less likely to fracture upon attempted delamination of the receiver sheet. Preferably, the void volume not in excess of 80% as a greater void volume may lead to structural instability of the substrate which may thus lack suitable durability. A particularly preferred void volume is in the range 60 to 70% which suitably provides a balance of durability and protection against delamination without fracture of the substrate.

The substrate is suitably produced by a method, as for example disclosed in U.S. Pat. No. 4,861,644, which involves extruding a mixture comprising a plastics material, optionally with other components, which is to form the substrate and a processing material and then forming a sheet by passing the said materials through a sheeting die. Suitably, the processing material is then removed from the sheet, for example by solvent extraction and subsequent removal of any residues of the said solvent, to form a substrate comprising a porous plastics material.

Although a porous substrate has the various advantages listed above, it also has one serious disadvantage in that it is permeable to the dyes forming the printed image in the receiver layer, in particular magenta dye. Thus, when a receiver layer is placed directly on a porous substrate, the image dye has a tendency to diffuse out of the receiver layer into the substrate leading to a less dense image and, because of the preferential permeability to magneta dye, a colour imbalance in the image. In extreme cases, the dye can permeate completely through the substrate causing discolouration of the rear surface.

Under certain circumstances, receiver sheets can be subjected to extremely high ambient temperature, for example when exposed to sunlight in a vehicle an ambient temperature up to 60° C., and possibly as high as 80° C., may be reached and moreover, there is a specific requirement by the International Civil Aviation Agency that machine readable passports can withstand being stored at such temperatures. Unfortunately, the diffusion effect increases with temperature and at these higher temperatures there can be a significant deterioration of the image.

It is a further object of this invention to reduce the diffusion effect thus enabling the use of porous substrates in identity card type situations where high ambient temperatures are possible.

According to a further aspect of the invention, there is provided a thermal transfer printing receiver sheet comprising a substrate having on one side a dye receiving layer, wherein the substrate is a porous material and a sub-layer is interposed between the substrate and the dye receiving layer, the sub-layer being such as to provide a dye permeability value at 60° C. of less than 20%.

The term dye permeability value is herein defined as being the percentage reduction in the measured Optical Density of the printed image at a specified temperature.

Preferably the sub-layer is such as to provide a dye permeability value at 80° C. of less than 20%.

Whilst the substrate is preferably a plastics material as disclosed in U.S. Pat. No. 4,861,644, it may alternatively be a resin bonded paper such as type E86016 supplied by Felix Schoeller, or ordinary plain paper.

As mentioned previously, it is advantageous if, in the event of delamination being attempted, fracture occurs in the substrate itself rather than at the interface between the layers. Hence it is desirable that the sub-layer has good adhesion and according to a preferred feature of the invention, the bond strength to the substrate is at least 10 N/cm.

The porosity of the surface of the substrate means that there is a tendency for coatings suitable for solid or foamed substrates to soak into the surface producing a grainy finish which can be reflected in the image appearance. Hence it is desirable that the sub-coat be such as to provide good filling and smoothing of the surface and to this end a further preferred feature of the invention provides for the sub-layer to have a solids content when applied of at least 20%.

The sub-layer provides for excellent bonding between the substrate and the dye-receiving layer as a consequence of which any fracture which occurs in the receiver sheet due to attempted delamination is less likely to occur along a plane between adjacent layers in the sheet and suitably occurs within a layer, preferably the substrate, thus providing evidence of tampering.

Preferably, the sub-layer is relatively soft so that any fracture in the receiver sheet is more likely to occur in the substrate than in the sub-layer.

The sub-layer is preferably substantially resistant to solvents conventionally employed in fill coating processes. Further, the sub-layer is preferably also impermeable to the materials in the dye receiving layer and suitably presents a barrier between the substrate and the dye receiving layer to reduce the possibility of absorption of materials by the substrate which may cause variation in the composition or thickness of the dye-receiving layer or leave areas of the substrate exposed at the surface of the receiver sheet.

Suitably, the sub-layer comprises an acrylic acid/vinyl acetate copolymer, an acrylic acid/vinylidene chloride copolymer, or a poly vinyl alcohol.

The bond strength may be improved if required by the addition of, for example a sulphonated polyester, although at the expense of a slight increase in the permeability value.

The receiver sheet may comprise a back coat on the opposite side of the substrate to the dye-receiving surface to impart desirable properties for example, to improve handling characteristics and to aid adhesion of a protective cover sheet to the sheet.

Suitably a receiver sheet according to the present invention is laminated with a cover sheet on both sides following imaging to provide protection for the images on the sheet. The cover sheet may be the same or different on the different sides of the sheet and is preferably transparent on at least one side of the sheet. The cover sheet suitably comprises a thermoplastic film, for example polyvinyl chloride, polyethylene terephthalate and polycarbonate compositions.

The cover sheet can be a supportive card-like sheet and if desired may itself be a laminate suitably where a functional feature is to be retained between the layers of the laminate. Such sheets are particularly suitable for standalone uses for example credit cards, security cards and card-keys where a suitable thickness may about 200 μm for the cover sheets and 50 to 300, preferably 100 to 275 μm, for the receiver sheet.

For security card applications, it is particularly desirable to provide a finished card which conforms to the ISO standard thickness of 760 μm±80 μm.

For other applications, much thinner cover sheets may be preferred for example pouch laminates in which both cover sheets on a receiver sheet extend beyond the edge of the sheet and are bonded together around their periphery.

The dye-receiving layer preferably comprises at least one dye-receptive polymer which is suitably an amorphous polyester.

The polymer may comprise other polymers for example polyvinyl chloride and polyvinyl alcohol/polyvinyl chloride copolymer as desired.

Commercially available examples of suitable amorphous polyesters include VITEL (RTM) PE200 (Goodyear) and VYLON (RTM) polyesters (Toyobo) especially grades 103 and 200. Different grades of polyester may be mixed to provide a suitable composition as desired.

If desired, the receiver layer may also comprise a release agent. A preferred release agent is the thermoset reaction product of at least one silicone having a plurality of hydroxyl groups per molecule and at least one organic polyfunctional N-(alkoxymethyl) amine resin which is reactive with the hydroxyl groups under acid catalysed conditions.

Suitably, the back coat, if present, comprises a cross-linked polymer binder and is provided to impart desirable properties to the receiver sheet for example improved handling characteristics and reduced tendency to retransfer the dye at low temperatures. If desired, the back coat may have a textured surface which may be imparted by a filler material or by the polymer per se.

The invention is illustrated by the following non-limiting examples.

EXAMPLE 1

A porous plastics material substrate available under the trade name TESLIN (RTM), available from PPG Industry Inc, of thickness 255 μm was coated with a receiver layer solution consisting of the following composition:

| | |
|---|---|
| VYLON 600<br>(Polyester available from Toyobo) | 100 g |
| BEETLE RTM) 692<br>(A poly functional N-alkyl Methyl amine cross-linking agent available from British Industrial Plastics) | 6 g |
| TEGOMER (RTm) 2311<br>(A hydroxy functional silicone release agent available from Goldschmidt) | 0.075 g |
| TIMUVIN (RTM) 900<br>(A hydroxylated benztriazole uv absorber available from Ciba Geigy) | 1.0 g |
| p-toluene sulpHonic acid | 0.5 g |

The receiver layer solution was a 20% solids solution in methylethylketone: toluene (1:1) and was dried on the sub-layer at 80° C. for 2 minutes to give a receiver sheet according to the invention.

The receiver sheet was cut into 100×126 mm rectangles and given registration marks and were then printed in a thermal transfer printing process in a Hitachi VY200 video printer using a dye sheet available from ICI Imagedata under catalogue number 105010 to provide cyan, magenta and yellow colour blocks of varying optical densities.

In this process, there were no mis-feeds, double-feeds or mis-registration of the receiver sheet.

The optical density of the colour blocks was determined using a Macbeth TR1224 densitometer.

The maximum optical densities were as follows: Yellow—up to 2.72; Cyan —up to 2.30; Magenta—up to 2.67.

EXAMPLE 2

The imaged receiver sheets produced in Example 1 were laminated using a hot roll laminator Type 5020 (available from Morane Ltd) at a temperature of 170° C. on the receiver layer side with a cover sheet of DDOT (a hot melt polyester adhesive coated transparent polyethylene terephthalate film available from Transilwrap) and on the opposite side, a cover sheet of 7/3 (a hot melt ethylene/vinyl acetate adhesive coated transparent polyethylene terephthalate film available from Transilwrap) and cut into 2×10 cm strips.

The strips were then subjected to a peel test using an Instron 6021 mechanical tester. The imaged side exhibited a bond strength of 30 to 40 N/cm and the non imaged side, a bond strength of 20 to 30 N/cm.

The cards were found to be extremely difficult to delaminate by hand although it was possible to delaminate strips which failed either in the substrate or the sub-layer thus providing evidence of tampering. There was no failure between the cover sheet and the imaged receiver layer.

EXAMPLE 3

An imaged receiver sheet produced in accordance with Example 1 and cut into a flush cut card was immersed in water at 20° C. for 30 minutes and was found to be structurally intact and was intact following a 40° C. wash cycle in an automatic washing machine thus demonstrating good resistance to water.

A flush cut paper-based substrate receiver sheet absorbed water, swelled and the paper core delaminated demonstrating its lack of durability when exposed to water.

EXAMPLE 4

A series of receiver sheet samples were produced in accordance with Example 1 except that prior to the application of the receiver layer the substrate samples were coated by reverse gravure with 20% solids aqueous emulsions to give a 1 μm sub-layer of the following materials:

Sample A Standard—no sub-layer

Sample B Comparative—VINAMUL (RTM) 3303, an ethylene/vinyl acetate copolymer available from Vinamul Ltd.

Sample C VISCALEX (RTM) VG2, an acrylic acid/vinyl acetate copolymer available from Allied Colloids;

Sample D CARBOPOL (RTM) 907, an acrylic acid/vinyl acetate copolymer available from B F Goodrich;

Sample E TEXICOTE (RTM) 03052, a poly vinyl alcohol available from Scott Bader;

Sample F DIOFAN (RTM) 185D, an acrylic acid/vinylidene chloride copolymer available from BASF;

Sample G DIOFAN 193D, an acrylic acid/vinylidene copolymer available from BASF;

Each sample was printed in a Hitachi VY200 printer at full power using a magenta dye sheet. The Optical Density of the resultant colour block was measured using the Macbeth densitometer.

The samples were subjected to elevated temperatures and the optical densities re-measured. The results are shown in the Table.

Identical samples were prepared and laminated to a DDOT cover sheet and subjected to a peel test as described in Example 2. The results are again shown in the Table.

TABLE

| | 60 HOURS AT 60° C. | | | 60 HOURS AT 80° C. | | | |
|---|---|---|---|---|---|---|---|
| SAMPLE | INITIAL OD | FINAL OD | DIFF % | INITIAL OD | FINAL OD | DIFF % | BOND STRENGTH (N/cm) |
| A | 1.96 | 1.18 | 40.0 | 1.90 | 0.54 | 71.0 | <10 |
| B | 1.94 | 1.26 | 34.6 | 1.91 | 0.67 | 65.0 | >30 |
| C | 1.95 | 1.84 | 5.6 | 1.87 | 1.7 | 9.1 | 10 |
| D | 1.95 | 1.83 | 6.1 | 1.89 | 1.68 | 11.1 | 10 |
| E | 1.96 | 1.84 | 6.1 | 1.88 | 1.66 | 11.7 | 10 |
| F | 1.95 | 1.93 | 1.0 | 1.92 | 1.68 | 12.5 | >30 |
| G | 1.94 | 1.91 | 1.5 | 1.93 | 1.64 | 15.0 | >30 |

EXAMPLE 5

Example 4 was repeated except that sub-layers were formed from VICLAN (RTM) 801, VICLAN 834 and VICLAN 872 (acrylic acid/vinylidene chloride copolymers available from ICI). Similar results to Samples F and G were obtained except that the VICLAN 872 had a lower bond strength of 25N/cm.

EXAMPLE 6

Sample B of Example 4 was repeated except that the sub-layer contained in addition 10% of EASTMAN (RTM) SIZE WD30 (a sulphonated polyester available from Eastman Kodak). An improvement in the bond strength to 25N/cm was achieved at the expense of an increase in the dye permeability value at 80° C. to 15%.

EXAMPLE 7

Example 4 was repeated except that resin bonded paper (E86016 available from Felix Schoeller) and plain paper were used as substrates. Similar results were obtained.

We claim:

1. A thermal transfer printing receiver sheet comprising a substrate having on one side thereof a dye receiving layer, characterised in that the substrate comprises a porous plastics material having a network of interconnecting pores communicating throughout the substrate.

2. A receiver sheet according to claim 1 wherein said pores constitute at least 50% by volume of said substrate.

3. A receiver sheet according to claim 2, wherein said pores constitute 60 to 70% by volume of said substrate.

4. A receiver sheet according to claim 1, 2 or 3, wherein the pores have a maximum dimension of 0.01 to 20 μm.

5. A receiver sheet according to claims 1, 2 or 3, wherein a sub-layer is interposed between the substrate and the dye receiving layer.

6. A receiver sheet according to claim 5, wherein the sub-layer is such as to provide the receiver sheet with a dye permeability value at 60° C. of less than 20%.

7. A receiver sheet according to claim 5, wherein the sub-layer is such as to provide the receiver sheet with a dye permeability value at 80° C. of less than 20%.

8. A receiver sheet according to claim 5, wherein the sub-layer has a bond strength to the substrate of at least 10 N/cm.

9. A receiver sheet according to claim 5, wherein the sub-layer has a solids content on coating of at least 20 wt %.

10. A receiver sheet according to claim 5, wherein the material of the sub-layer is an acrylic acid/vinyl acetate copolymer, an acrylic acid/vinylidene chloride copolymer or a poly vinyl alcohol.

11. A thermal transfer printing receiver sheet comprising a substrate having on one side a dye receiving layer, wherein the substrate comprises a porous plastic material and a sub-layer is interposed between the substrate and the dye receiving layer, characterised by the sub-layer being such as to provide the receiver sheet with a dye permeability value at 60° C. of less than 20%.

12. A receiver sheet according to claim 11, wherein the sub-layer is such as to provide the receiver sheet with a dye permeability value at 80° C. of less than 20%.

13. A receiver sheet according to claim 11 or 12, wherein the sub-layer has a bond strength to the substrate of at least 10 N/cm.

14. A receiver sheet according to any of claims 11 or 12, wherein the sub-layer has a solids content on coating of at least 20 wt %.

15. A receiver sheet according to claim 11, wherein the material of the sub-layer is an acrylic acid/vinyl acetate copolymer, an acrylic acid/vinylidene chloride copolymer or a poly vinyl alcohol.

16. A receiver sheet according to claim 11, wherein the substrate is a porous plastics material having a network of interconnecting pores communicating throughout the substrate.

17. A receiver sheet according to claim 16, wherein said pores constitute at least 50% by volume of said substrate.

18. A receiver sheet according to claim 16, wherein said pores constitute 60 to 70% by volume of said substrate.

19. A receiver sheet according to claim 16, 17, or 18, wherein the pores have a maximum dimension of 0.01 to 20 μm.

* * * * *